US010596568B2

(12) United States Patent
Walton et al.

(10) Patent No.: US 10,596,568 B2
(45) Date of Patent: Mar. 24, 2020

(54) FLUID LOADING INTO A MICROFLUIDIC DEVICE

(71) Applicant: Sharp Life Science (EU) Limited, Oxford (GB)

(72) Inventors: Emma Jayne Walton, Oxford (GB); Lesley Anne Parry-Jones, Oxford (GB)

(73) Assignee: Sharp Life Science (EU) Limited, Oxford (GB)

( * ) Notice: Subject to any disclaimer, the term of this patent is extended or adjusted under 35 U.S.C. 154(b) by 236 days.

(21) Appl. No.: 15/728,071

(22) Filed: Oct. 9, 2017

(65) Prior Publication Data

US 2018/0104687 A1 Apr. 19, 2018

(30) Foreign Application Priority Data

Oct. 19, 2016 (EP) ..... 16194632

(51) Int. Cl.
*B01L 3/00* (2006.01)

(52) U.S. Cl.
CPC ..... *B01L 3/50273* (2013.01); *B01L 3/502715* (2013.01); *B01L 3/52* (2013.01);
(Continued)

(58) Field of Classification Search
CPC ..... B01L 2200/027; B01L 2200/0605; B01L 200/0642; B01L 2300/0864;
(Continued)

(56) References Cited

U.S. PATENT DOCUMENTS 5,096,669 A 3/1992 Lauks et al.
7,407,630 B2 * 8/2008 Reed ..... G01N 35/028 422/552

(Continued)

FOREIGN PATENT DOCUMENTS

WO WO 2006102298 9/2006
WO WO 2014078100 5/2014

OTHER PUBLICATIONS

Extended European Search Report of EP Application No. 16194632.2 dated May 3, 2017, 9 pages.

(Continued)

*Primary Examiner* — Maureen Wallenhorst
(74) *Attorney, Agent, or Firm* — Renner, Otto, Boisselle & Sklar, LLP

(57) ABSTRACT

A fluid loader is provided for loading fluid into a microfluidic device, the microfluidic device having upper and lower spaced apart substrates defining a fluid chamber therebetween and an aperture for receiving fluid into the fluid chamber. The fluid loader includes a fluid well communicating with a fluid exit provided in a base of the fluid loader. The base of the fluid loader is shaped, in use, to locate the fluid loader relative to the aperture, and to direct fluid leaving the fluid loader via the fluid exit preferentially in a first direction in the fluid chamber of the microfluidic device. In one embodiment the base of the fluid loader includes a protruding portion having at least first and second legs, the first leg being shorter than the second leg. In use, the fluid loader is positioned such that the first leg of the fluid loader is between a fluid loading area associated with the aperture and an operating area of the device.

22 Claims, 14 Drawing Sheets

(52) U.S. Cl.
CPC ... *B01L 3/502792* (2013.01); *B01L 2200/027* (2013.01); *B01L 2200/0605* (2013.01); *B01L 2200/0642* (2013.01); *B01L 2300/0864* (2013.01); *B01L 2400/0427* (2013.01); *Y10T 436/2575* (2015.01)

(58) Field of Classification Search
CPC ..... B01L 2400/0427; B01L 3/502715; B01L 3/50273; B01L 3/502792; B01L 3/52; Y10T 436/2575
USPC ..... 436/180; 422/502, 504, 507
See application file for complete search history.

(56) References Cited

U.S. PATENT DOCUMENTS

| | | | |
|---|---|---|---|
| 2010/0282608 | A1 | 11/2010 | Srinivasan et al. |
| 2010/0282609 | A1 | 11/2010 | Pollack et al. |
| 2013/0161193 | A1 | 6/2013 | Jacobs et al. |
| 2019/0039072 | A1* | 2/2019 | Walton ..... B01L 3/502715 |

OTHER PUBLICATIONS

"Digital microfluidics: is a true lab-on-a-chip possible?", R.B. Fair, Microfluid Nanofluid (2007) 3:245-281).

* cited by examiner

FLUID LOADING INTO A MICROFLUIDIC DEVICE

TECHNICAL FIELD

The present invention relates to loading fluid into a microfluidic device, and more particularly to loading fluid into an Active Matrix Electro-wetting on Dielectric (AM-EWOD) microfluidic device. Electro-wetting-On-Dielectric (EWOD) is a known technique for manipulating droplets of fluid on an array. Active Matrix EWOD (AM-EWOD) refers to implementation of EWOD in an active matrix array incorporating transistors, for example by using thin film transistors (TFTs).

BACKGROUND OF THE INVENTION

Microfluidics is a rapidly expanding field concerned with the manipulation and precise control of fluids on a small scale, often dealing with sub-microlitre volumes. There is growing interest in its application to chemical or biochemical assay and synthesis, both in research and production, and applied to healthcare diagnostics ("lab-on-a-chip"). In the latter case, the small nature of such devices allows rapid testing at point of need using much smaller clinical sample volumes than for traditional lab-based testing.

A microfluidic device can be identified by the fact that it has one or more channels (or more generally gaps) with at least one dimension less than 1 millimetre (mm). Common fluids used in microfluidic devices include whole blood samples, bacterial cell suspensions, protein or antibody solutions and various buffers. Microfluidic devices can be used to obtain a variety of interesting measurements including molecular diffusion coefficients, fluid viscosity, pH, chemical binding coefficients and enzyme reaction kinetics. Other applications for microfluidic devices include capillary electrophoresis, isoelectric focusing, immunoassays, enzymatic assays, flow cytometry, sample injection of proteins for analysis via mass spectrometry, PCR amplification, DNA analysis, cell manipulation, cell separation, cell patterning and chemical gradient formation. Many of these applications have utility for clinical diagnostics.

Many techniques are known for the manipulation of fluids on the sub-millimetre scale, characterised principally by laminar flow and dominance of surface forces over bulk forces. Most fall into the category of continuous flow systems, often employing cumbersome external pipework and pumps. Systems employing discrete droplets instead have the advantage of greater flexibility of function.

Electro-wetting on dielectric (EWOD) is a well-known technique for manipulating discrete droplets of fluid by application of an electric field. It is thus a candidate technology for microfluidics for lab-on-a-chip technology. An introduction to the basic principles of the technology can be found in "Digital microfluidics: is a true lab-on-a-chip possible?" (R. B. Fair, Microfluid Nanofluid (2007) 3:245-281). This review notes that methods for introducing fluids into the EWOD device are not discussed at length in the literature. It should be noted that this technology employs the use of hydrophobic internal surfaces. In general, therefore, it is energetically unfavourable for aqueous fluids to fill into such a device from outside by capillary action alone. Further, this may still be true when a voltage is applied and the device is in an actuated state. Capillary filling of non-polar fluids (e.g. oil) may be energetically favourable due to the lower surface tension at the liquid-solid interface.

A few examples exist of small microfluidic devices where fluid input mechanisms are described. U.S. Pat. No. 5,096,669 (Lauks et al.; published Mar. 17, 1992) shows such a device comprising an entrance hole and inlet channel for sample input coupled with an air bladder which pumps fluid around the device when actuated. It is does not describe how to input discrete droplets of fluid into the system nor does it describe a method of measuring or controlling the inputted volume of such droplets. Such control of input volume (known as "metering") is important in avoiding overloading the device with excess fluid and helps in the accuracy of assays carried out where known volumes or volume ratios are required.

US20100282608 (Srinivasan et al.; published Nov. 11, 2010) describes an EWOD device comprising an upper section of two portions with an aperture through which fluids may enter. It does not describe how fluids may be forced into the device nor does it describe a method of measuring or controlling the inputted volume of such fluids. Related application US20100282609 (Pollack et al.; published Nov. 11, 2010) does describe a piston mechanism for inputting the fluid, but again does not describe a method of measuring or controlling the inputted volume of such fluid.

US20100282609 describes the use of a piston to force fluid onto reservoirs contained in a device already loaded with oil. US20130161193 describes a method to drive fluid onto a device filled with oil by using, for example, a bistable actuator.

SUMMARY OF INVENTION

A first aspect of the invention provides a fluid loader for loading fluid into a microfluidic device, the microfluidic device having upper and lower spaced apart substrates defining a fluid chamber therebetween and an aperture for receiving fluid into the fluid chamber, wherein the fluid loader comprises a fluid well communicating with a fluid exit provided in a base of the fluid loader; and wherein the base of the fluid loader is shaped, in use, to locate the fluid loader relative to the aperture and to direct fluid leaving the fluid loader via the fluid exit preferentially in a first direction in the fluid chamber of the microfluidic device.

The fluid loader may be a fluid loader for loading fluid into an EWOD device.

The base of the fluid loader may comprise a protruding portion (23) so shaped and so dimensioned as to be receivable in the aperture, the protruding portion (23) being shaped to direct fluid leaving the fluid loader preferentially in the first direction.

The protruding portion may extend wholly or partially around the fluid exit.

The base of the fluid loader may comprise a protruding portion so shaped and so dimensioned as to position the fluid exit adjacent to the aperture, the protruding portion being shaped to direct fluid leaving the fluid loader preferentially in the first direction.

The protruding portion may comprise at least first and second legs, the first leg being of different length to the second leg.

The length of the first leg may be substantially equal to the thickness of the upper substrate.

The length of the second leg may be substantially equal to, but not greater than, the sum of the thickness of the upper substrate and the cell gap between the upper substrate and the lower substrate. Also, the length of the second leg may be equal to or greater than the sum of the thickness of the upper substrate and a half of the cell gap between the upper substrate and the lower substrate, or may be equal to or greater than the sum of the thickness of the upper substrate and three quarters of the cell gap between the upper substrate and the lower substrate.

The protruding portion of the fluid loader and the aperture may be configured such that, when the protruding portion of the fluid loader is received in the aperture, an airgap exists between the protruding portion of the fluid loader and the aperture.

One or more first regions of the aperture may have a greater radius than one or more second regions of the aperture.

One or more third regions of the protruding portion may have a lower radius than one or more fourth regions of the protruding portion.

The protruding portion comprises at least one portion made of a material relatively resistant to deformation and at least one portion made of a deformable material.

A second aspect of the invention provides a fluid loading cassette comprising two or more fluid loaders for loading a respective assay fluid into the microfluidic device, each fluid loader being a fluid loader of the first aspect.

The fluid loading cassette may further comprise a fluid loader for loading filler fluid into the microfluidic device.

The base of the fluid loader for loading filler fluid may comprises a protruding portion configured to be receivable in a corresponding aperture in the microfluidic device and to cause loading of filler fluid at a pre-determined rate.

A third aspect of the invention provides a method of loading assay fluid into a microfluidic device, the method comprising: providing a fluid loader comprising a fluid well communicating with a fluid exit provided in a base of the fluid loader; positioning the fluid loader such that the fluid exit is adjacent an aperture in the microfluidic device; and causing assay fluid to pass from the fluid loader into a fluid chamber of the microfluidic device; wherein the base is shaped, in use, to locate the fluid loader relative to the aperture and to direct assay fluid leaving the fluid loader via the fluid exit preferentially in a first direction in the fluid chamber of the microfluidic device. In a method of the third aspect the fluid loader may be any fluid loader according to the first aspect.

In a method of the third aspect the base of the fluid loader may comprise a protruding portion having at least first and second legs, the first leg being shorter than the second leg, and the method may comprise positioning the fluid loader such that the first leg of the fluid loader is between a fluid loading area associated with the aperture and an operating area of the device.

A method of the third aspect may comprise positioning the fluid loader such that the fluid exit is adjacent an aperture in an upper substrate of the microfluidic device. Alternatively, it may comprise positioning the fluid loader such that the fluid exit is adjacent an aperture defined at a side of the microfluidic device and between an upper substrate of the microfluidic device and a lower substrate of the microfluidic device.

Causing assay fluid to pass from the fluid loader into the fluid chamber of the microfluidic device may comprise venting the fluid loader the fluid loader at a point above an upper surface of assay fluid contained in the fluid loader. It may further comprise introducing a filler fluid into the fluid chamber of the microfluidic device.

A fourth aspect of the invention provides a method of loading assay fluid into a microfluidic device, the method comprising: positioning a fluid loading cassette of the second aspect such that fluid exits of the fluid loaders in the well are adjacent respective apertures in the microfluidic device; and causing assay fluid to pass from at least one fluid loader of the fluid loading cassette (18) into a fluid chamber of the microfluidic device (10).

In a method of the fourth aspect the fluid loading cassette may further comprise a fluid loader for loading filler fluid into the microfluidic device, and the method may comprise: venting at least one assay fluid-containing fluid loader of the cassette, and subsequently venting the filler fluid-containing fluid loader of the cassette.

BRIEF DESCRIPTION OF FIGURES

To the accomplishment of the foregoing and related ends, the invention comprises the features hereinafter fully described and identified in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

Figure 1:
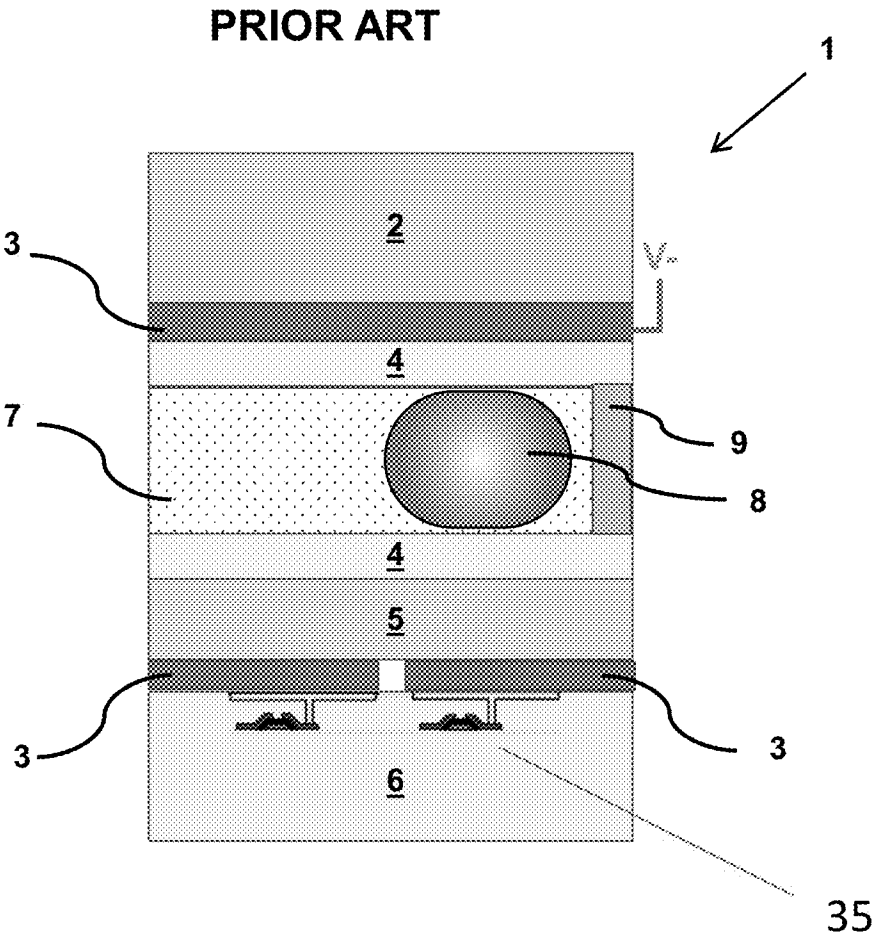
FIG. 1 is a schematic diagram depicting a conventional AM-EWOD device in cross-section.

FIG. 1 is a schematic diagram depicting a conventional AM-EWOD device 1 in cross-section. The AM-EWOD device 1 has a lower substrate 6, which is typically (but not necessarily) made from glass, and acts as a support for a thin film electronic structure (e.g. an array of thin film transistors 35) made from low temperature polysilicon (LTPS), and constructed using a standard display manufacturing process. The device 1 also has an upper substrate 2, which is typically (but not necessarily) made from glass. Electrodes 3 are disposed upon the upper and lower substrates 2, 6, and are typically (but not necessarily) made from either a transparent conductor (such as indium tin oxide (ITO)) or a reflective conductor (such as aluminium). The electrodes 3 will subsequently be used to control the movement of liquid droplets 8 through the device 1. The lower substrate 6 may further be provided with an insulator layer 5.

The inner surfaces of the upper 2 and lower substrates 6 may have a hydrophobic coating 4. Non-limiting examples of materials that may be used to form the hydrophobic coating include Teflon® AF1600 (polytetrafluoroethylene), Cytop™, Fluoropel™, Parylene C and Parylene HT.

A spacer 9 maintains a suitably sized and well-controlled spacing between the upper 2 and lower substrates 6. In some cases it can also form a continuous seal around the perimeter of the device, which helps to contain fluids that will subsequently be introduced into the device.

The upper substrate 2 may have formed within it one or more apertures 14, 15 (not shown in FIG. 1, but shown in FIG. 2) which provide a means of fluids entering and exiting the device, in the case where the spacer 9 acts as a continuous seal around the perimeter of the device. In the case where the spacer 9 does not form a continuous seal around the perimeter of the device, fluids can enter and exit the device laterally and there is no need for apertures within the upper substrate 2.

A liquid droplet 8, which may consist of any polar liquid and which typically may be ionic and/or aqueous, is enclosed between the lower substrate 6 and the upper substrate 2, although it will be appreciated that multiple liquid droplets 8 can be present. The content of the liquid droplet will be referred to herein as "assay fluid" for convenience but, as explained below, this does not mean that the invention is limited to use in performing an assay.

During normal device operation, the droplets of assay fluid 8 are typically surrounded by a non-polar filler fluid 7, which could be an oil, for example dodecane, other alkane or silicone oil, or alternatively air. A key requirement of the filler fluid is that it is immiscible with the assay fluids.

A general requirement for the operation of the device is that the assay fluid comprises a polar fluid, typically a liquid that may be manipulated by electro-mechanical forces, such as the electro-wetting force, by the application of electrical signals to the electrodes. Typically, but not necessarily, the assay fluid may comprise an aqueous material, although non-aqueous assay fluids (e.g. ionic liquids) may also be manipulated. Typically, but not necessarily, the assay fluid may contain a concentration of dissolved salts, for example in the range 100 nM-100M or in the range 1 uM to 10M or in the range 10 uM to 1M or in the range 100 uM to 100 mM or in the range 1 mM to 10 mM.

Optionally, either the assay fluid or the filler fluid may contain a quantity of surfactant material, which may be beneficial for reducing the surface tension at the interface between the droplet and the filler fluid. The addition of a surfactant may have further benefits in reducing or eliminating unwanted physical or chemical interactions between the assay liquid and the hydrophobic surface. Non-liming examples of surfactants that may be used in electro-wetting on dielectric systems include Brij O20, Brij 58, Brij S100, Brij S10, Brij S20, Tetronic 1107, IGEPAL CA-520, IGEPAL CO-630, IGEPAL DM-970, Merpol OJ, Pluronic F108, Pluronic L-64, Pluronic F-68, Pluronic P-105, Pluronic F-127, Pluronic P-188, Tween-20, Span-20, Span-80, Tween-40, Tween-60.

Whilst the term assay is generally taken to refer to some analytical procedure, method or test, the term assay fluid in the scope of this invention may be taken more widely to refer to a fluid involved in any chemical or biochemical processes as may be performed on the AM-EWOD device, for example, but not limited to the following:

- A laboratory test for testing for the presence, absence or concentration of some molecular or bio-molecular species, for example a molecule, a protein, a sequence of nucleic acid etc.
- A medical or bio-medical test for testing for the presence, absence or concentration of some physiological fluid, species or substance, for example a medical diagnostic test
- A procedure for preparing a material sample, for example the extraction, purification and/or amplification of a biochemical species, including but not limited to, a nucleic acid, a protein from a sample, a single cell from a sample
- A procedure for synthesising a chemical or bio-chemical compound, including, but not limited to the examples of a protein, a nucleic acid, a pharmaceutical product or a radioactive tracer Here, and elsewhere, the invention has been described with regard to an Active Matrix Electro-wetting on dielectric device (AM-EWOD). It will be appreciated however that the invention, and the principles behind it, are equally applicable to a 'passive' EWOD device, whereby the electrodes are driven by external means, as is well known in prior art (e.g. R. B. Fair, Microfluid Nanofluid (2007) 3:245-281). Likewise, in this and subsequent embodiments the invention has been described in terms of an AM-EWOD device utilizing thin film electronics to implement array element circuits and driver systems in thin film transistor (TFT) technology. It will be appreciated that the invention could equally be realized using other standard electronic manufacturing processes to realise Active Matrix control, e.g. Complementary Metal Oxide Semiconductor (CMOS), bipolar junction transistors (BJTs), and other suitable processes.

Figure 2:
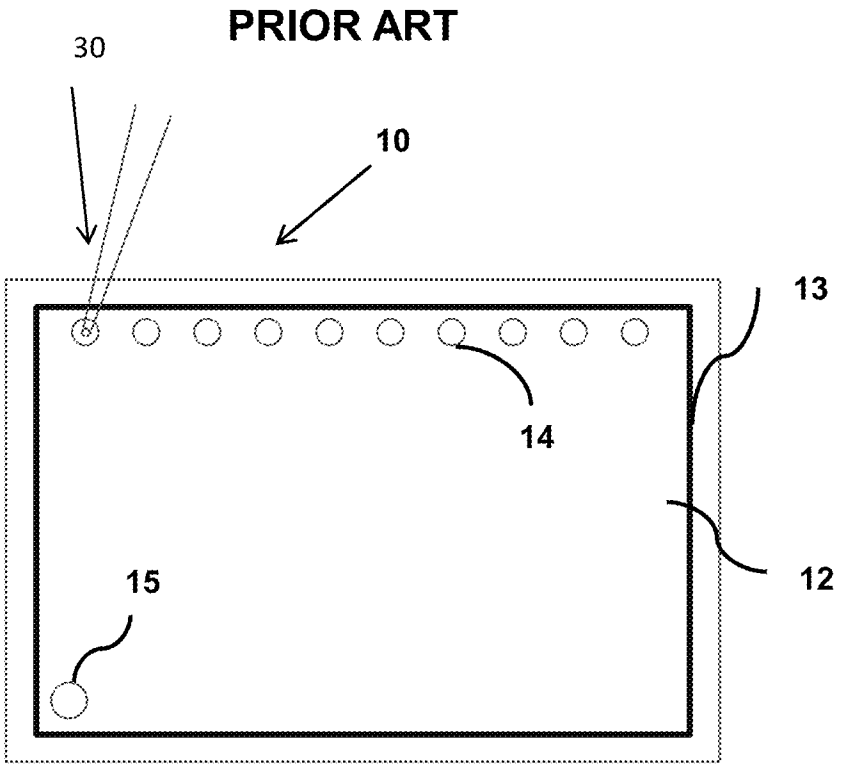
FIG. 2 is a schematic plan view of a conventional microfluidic device.

FIG. 2 is a schematic plan view from above of a microfluidic device. In this embodiment the device 10 is an electro-wetting on dielectric Active Matrix Electro-wetting on Dielectric (AM-EWOD) device comprising electrodes (not shown in FIG. 2). As in FIG. 1, the device 10 comprises a lower substrate (not visible in FIG. 2), an upper substrate spaced from the lower substrate so that a fluid chamber 12 is formed between the upper and lower substrates, and a fluid barrier provided between the lower substrate and the upper substrate 11 to define a perimeter of the fluid chamber 12. The interior of the chamber 12 is at least partially coated with a hydrophobic coating. In this illustrated example, the fluid barrier is an adhesive track 13 that also acts as the spacer between the upper substrate 2 and lower substrate 6. The adhesive track 13 adheres the upper substrate (in this example comprising ITO coated glass) to the lower substrate while holding the upper substrate a desired distance from the lower substrate (in this example comprising a TFT chip). In principle, however, a separate spacer could be provided in addition to the adhesive track 13.

The upper substrate is provided with one or more fluid input holes 14 for allowing an assay fluid to be introduced into the fluid chamber 12, and with at least one filler fluid input hole 15 for allowing filler fluid to be introduced into the fluid chamber 12. In some configurations a user is required to directly pipette fluid into the holes of the glass cartridge as indicated schematically by the pipette tip 30 in FIG. 2. Pipetting fluid directly into the holes of a glass cartridge is an acceptable approach for a competent laboratory user who is used to fluid handling with pipettes. This approach is, however, more challenging for someone less experienced in liquid handling. An improved fluid interface, which preferably is capable of being automated if a user or an application requires this, is therefore desired to provide simple operation for the user.

Figure 3:
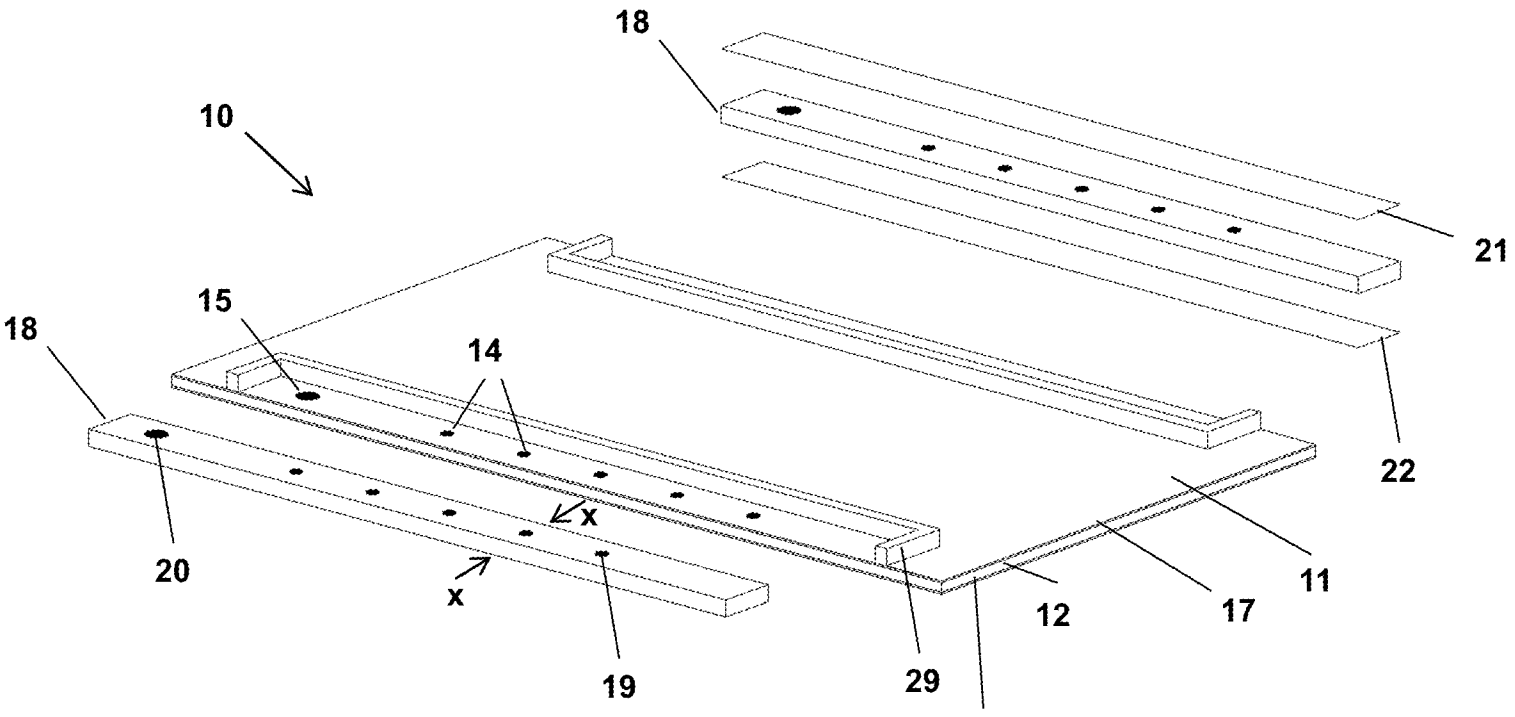
FIG. 3 is a schematic perspective view of a microfluidic device in accordance with an embodiment of the invention, in a disassembled state.

FIG. 3 is a perspective view of a microfluidic device according to an embodiment of the present invention. The device 10 has a cartridge 11 comprising a lower substrate 16 and an upper substrate 17, with a fluid chamber 12 defined between the lower substrate 16 and upper substrate 17. The device may be an EWOD device, or an active matrix EWOD device, but the invention is not limited to any specific type of microfluidic device.

Fluid port 14, 15 are provided in upper substrate 17, to allow a filler fluid (for example, oil) and one or more assay fluids to be introduced into the fluid chamber. The device of FIG. 3 further includes one or more fluid loading cassettes 18. Two cassettes 18 are shown in FIG. 3, but the invention is not limited to this number. A fluid loading cassette 18 is provided with multiple wells 19, 20 for holding assay fluid or filler fluid. In the example of FIG. 3 a cassette 18 has one well 20 for holding filler fluid and six wells 19 for holding assay fluid, but the invention is not limited to this particular configuration. The wells are provided in the cassette such that, when the cassette 18 is disposed on the upper substrate of the cartridge 11, each well 19, 20 in the cassette is aligned with a respective port 14, 15 in the upper substrate 17 of the cartridge.

Preferably, the device 10 is provided with a locator 29 for locating a cassette 18 in its correct position so that the cassette wells 19, 20 are correctly aligned with the fluid ports 14, 15. One locator 29 may be provided for each cassette. In the example of FIG. 3 the locater 29 takes the form of a generally "n"- or "u"-shaped projection from the upper substrate of the cartridge, but any suitable locator may be used.

Figure 4:
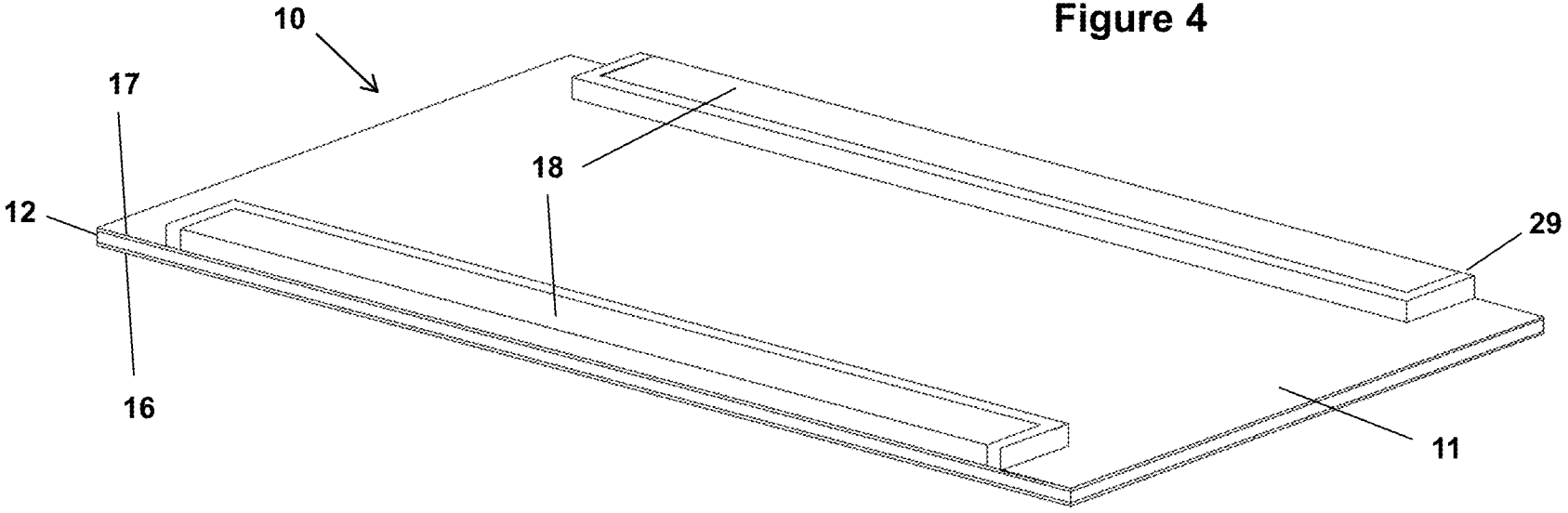
FIG. 4 is a schematic perspective view of the microfluidic device of FIG. 3 in an assembled state.

In one mode of operation, fluid is pre-loaded into the wells 19, 20 of a cassette, and the cassette is then sealed, typically by the manufacturer. A cassette may be sealed by means of sealing strips 21, 22 disposed respectively on the upper and lower surfaces of the cartridge, or alternatively each individual well in the cassette may be provided with its own seal or plug. The user is required to remove the lower seal(s) from a cassette, and then position the cassette 18 against the locator 29 such that the wells 19, 20 in the cassette align with the fluid ports 14, 15 in the upper substrate of the cartridge. The result of this is shown in FIG. 4. Since the upper seal 21 is still in place on the cassette, fluid is securely retained in the wells 19, 20. When the user is ready to commence loading fluid from a cassette, the upper seal 21 of that cassette is removed.

In use, a user would preferably remove the upper seal 21 such that the assay fluid wells 19 of a cassette were uncovered first, with the filler fluid well 20 being the last well to be uncovered. As the upper seal 21 is removed from the assay fluid wells thereby venting each uncovered assay fluid well at a point above the upper surface of assay fluid contained in the well and so exposing the upper surface of assay fluid in the well to the ambient pressure (typically atmospheric pressure), the assay fluid will tend to either remain in the wells or move into a fluid loading zone. The device is activated when the user removes the seal from the top of the filler fluid well thereby venting the filler fluid well at a point above the upper surface of filler fluid contained in the assay fluid wells and so exposing the upper surfaces of assay fluid in the assay fluid wells to the ambient pressure, and the filler fluid (optionally together with surfactant) then floods into the fluid chamber of the device and sweeps assay fluid out of the assay fluid wells as the filler fluid passes underneath each assay fluid well. All assay fluids now reside in a fluid loading zone ready to be moved, using EWOD control, to the main device operating area.

The assay fluid(s) thus enter the device in a controlled manner, and their subsequent direction and position may be controlled by the device software which starts, or is started, once fluids are loaded into the device. The device of the invention is therefore very simple to use, and requires very little user input.

The above description relates to a cassette that is pre-loaded with fluid. However, in principle a user might choose to have a cassette which is not pre-loaded with assay and filler fluid. One or more cassettes with empty fluid wells could be docked into position as described above, and then the user may load assay and filler fluid into a cassette, for example using a pipette—as the cassette wells 19,20 are larger in cross-section than the holes 14,15 in the glass cartridge, loading fluid into a cassette would be easier for a user than loading fluid direct into the cartridge, particularly where only very small volumes of assay reagents are needed.

In a further embodiment, one or more wells of a cassette could be pre-loaded with fluid while other wells are left empty for loading with fluid by a user once the cassette has been docked in position on the cartridge. For example, in such an embodiment one or more wells may be pre-loaded with filler fluid while other wells are left empty for loading with assay fluid(s) by a user.

Figure 5:
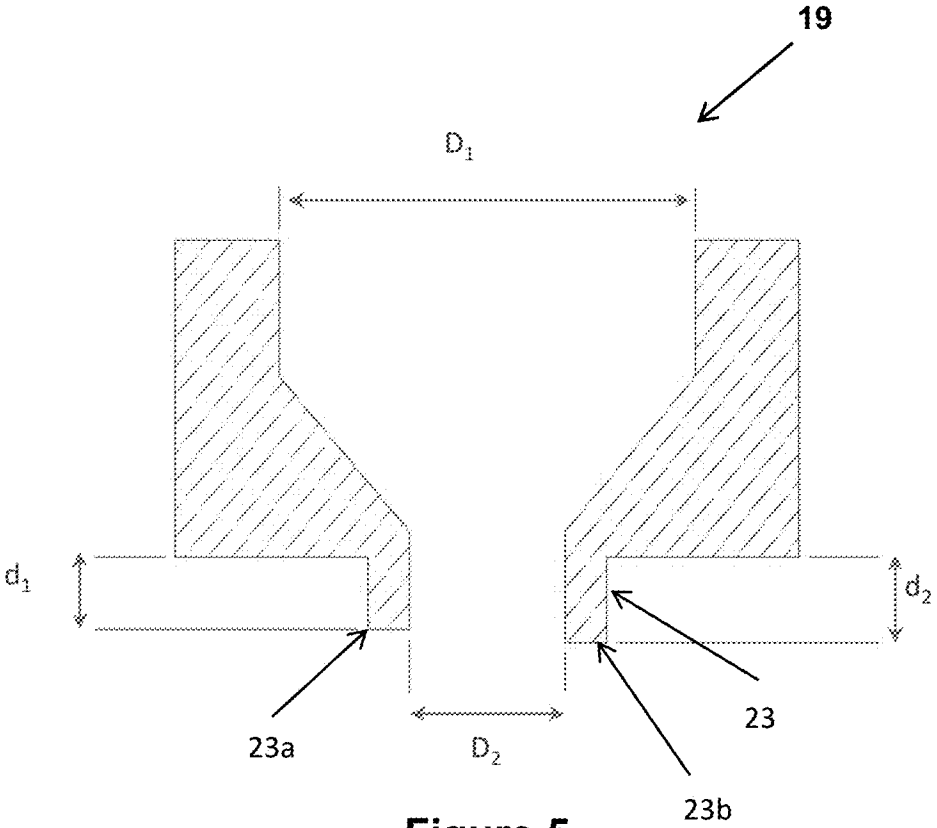
FIG. 5 is a schematic sectional view of a fluid well for a microfluidic device of the invention.

FIG. 5 is a cross-section of a cassette 18 along the line X-X of FIG. 3, through an assay fluid well 19. The design of an assay fluid well is subject to a number of considerations. The well needs to be large enough to accommodate the volume of assay fluid required for the assay. The shape and dimensions of the well needs to be chosen such that the assay fluid remains in the well (or enters the fluid loading zone, in the case of an assay fluid containing surfactant) until the filler fluid passes beneath the well, but once the filler fluid reaches the well fluid needs to be swept out of the well (or fluid loading zone) to ensure that the correct volume of assay fluid enters the device. (Depending on the application, it may be desired for all fluid to be swept out of an assay fluid well, or it may only be desired for part of the fluid in an assay well to be loaded into the device.)

Figure 6A:
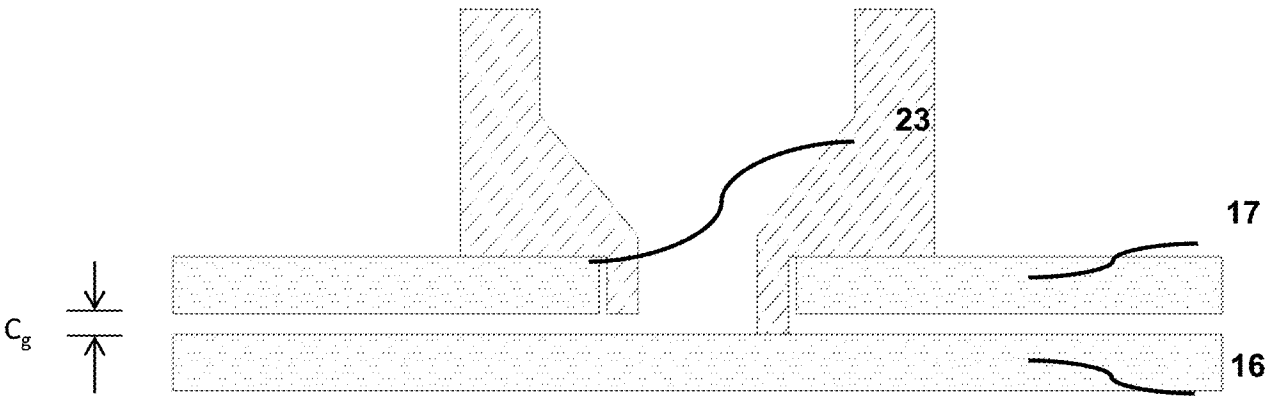
FIG. 6*a* is a part-sectional view showing the well of FIG. 5 in position.

The base of the assay fluid well 19 is provided with a protrusion 23 that is so shaped and so dimensioned as to be receivable in an assay fluid port 14 in the upper substrate, as shown schematically in FIG. 6*a*. According to the invention, and as can be seen in FIG. 5 or 6*a*, the protrusion 23 has a first portion, or "leg", 23*a*, having a first length $d_1$ and a second portion, or "leg", 23*b* having a greater length $d_2$ so that the protrusion can be considered as "asymmetric" insofar as it is not rotationally symmetric about its axis and so provides directional fluid loading properties.

Figure 6B:
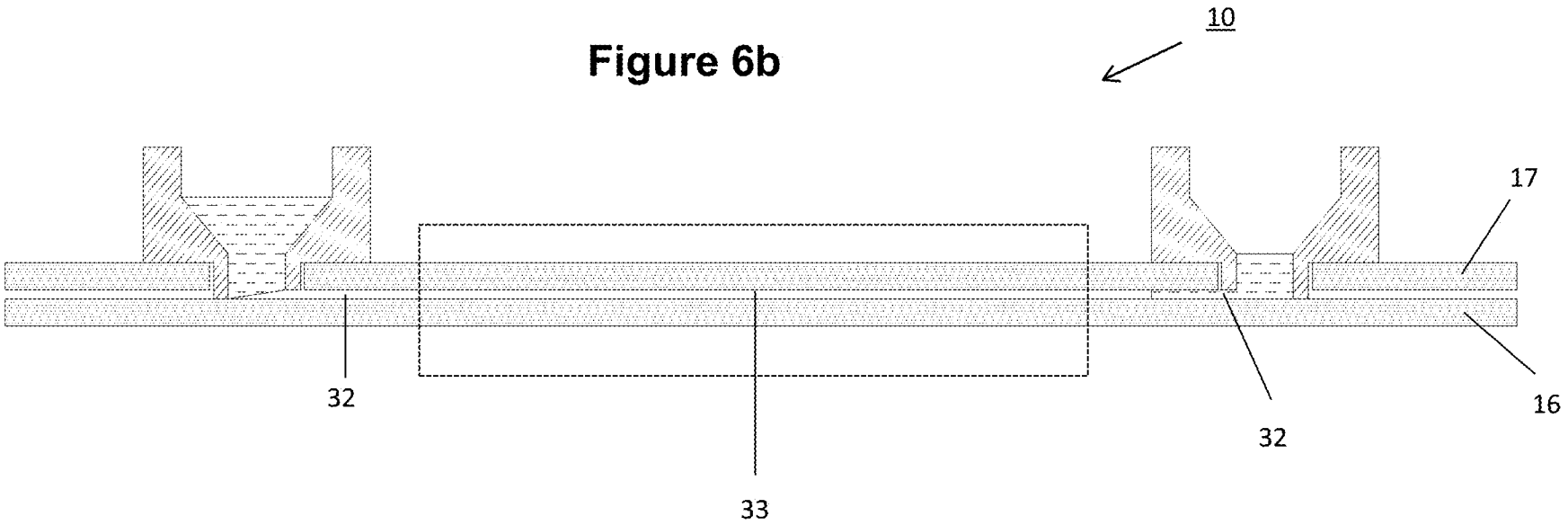
FIG. 6*b* is a schematic sectional view though a microfluidic cartridge showing two wells in position.

The effect of the invention is explained in FIG. 6*b*, which is a schematic sectional view through a microfluidic cartridge 11 showing two assay fluid wells, each having an "asymmetric" protrusion as shown in FIG. 5 or 6*a*.

The effect of providing the protrusion 23 of an assay fluid well with a short portion 23*a* and a long portion 23*b* is to provide directionality in the way fluid is loaded into the cartridge 11. There are two principal cases to consider, namely (1) loading of fluids that do not contain surfactant and (2) loading of fluids have surfactant in them—the behaviour of these fluids can be very different. The behaviour will be different for different levels of surfactant, different cell gaps and different well designs. However, the asymmetric well design of the invention gives better control over the loading of fluid whether or not the fluid contains surfactant.

The region of a cartridge 11 where fluid is loaded can be considered as a "fluid loading area"—in general, the region of a microfluidic device where a cassette is placed is a fluid loading region. Two fluid loading areas 32 are shown in FIG. 6*b*, for example corresponding to regions where the two cassettes are placed in FIG. 3, but this number of fluid loading regions is purely an example. The interior region of a cartridge can be considered as an "operating area" 33, where fluid(s) is/are manipulated, for example by electrodes such as the electrodes 3 shown in FIG. 1.

The left hand well in FIG. 6*b* illustrates loading fluid that does not contain surfactant (this is the most difficult fluid to load into an EWOD device or other microfluidic device in a controlled manner). If the upper seal from the cassette containing the left hand assay fluid well in FIG. 6*b* is removed then the assay fluid without surfactant is likely to remain in the well as shown in FIG. 6*b* (although if the cell gap were very large, e.g. 1 mm, assay fluid without surfactant might not remain in the assay fluid well). When filler fluid is introduced into the cartridge, the long leg 23*b* of the assay fluid well encourages filler fluid to occupy the space directly underneath the assay fluid well. This assists in ensuring correct loading of the device. Filler fluid would naturally prefer to flow around holes in glass top plate and so would preferentially fill regions of the cartridge that were not under the assay fluid well, but if the filler fluid were to fill the bulk of the cartridge before filling under the assay fluid wells then the device would already be full when the filler fluid filled under the assay fluid wells—assay fluid could therefore not be drawn into the device as there would be no room for it. In the present invention providing the longer leg 23*b* of the assay fluid well overcomes this natural tendency of the filler fluid to avoid the region of the cartridge under the assay fluid well.

When the filler fluid, enters the region under the assay fluid well, an interface is formed between the filler fluid and assay fluid, changing the surface tension at the boundary of the assay fluid. This encourages assay fluid to leave the well and pass into the loading area 32 of the device. In addition, the asymmetric legs 23*a*,23*b* give directionality to the assay fluid, since the longer leg 23*b* of the well constrains assay fluid that has passed into the loading area 32. The fluid is directed onto the loading area of the device; also, if the assay fluid well is oriented with the longer leg 23*b* away from the operating area 33, assay fluid that enters the loading area 32 is prevented/restrained from flowing away from the operating area.

With filler fluid now present in the device, assay fluid that is loaded into the cartridge can be manipulated, for example using EWOD control, onto the main operating area of the device.

Figure 10A:
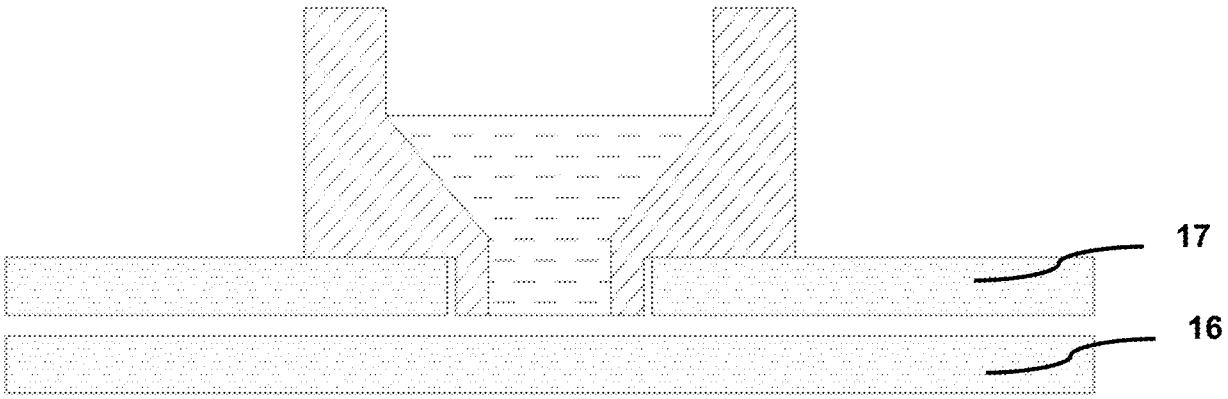
FIGS. 10*a* and 10*b* are part-sectional views illustrating a further advantage of the present invention.
Figure 10B:
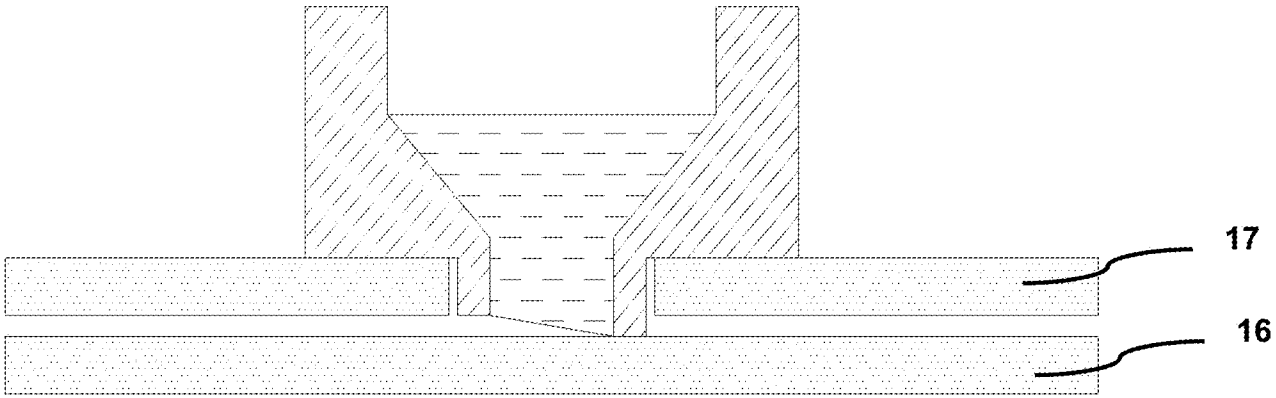

In addition, the asymmetric leg design provides a tilted meniscus to the fluid, as discussed more fully with respect to FIG. 10*b* below, which increases the chance of filler fluid and fluid meeting without trapping air. Further, if the length of the longer leg 23*b* is such that the leg 23*b* made touches the bottom TFT substrate 16 when the well is in position then, even before the filler fluid is loaded, assay fluid in the well is already touching the bottom substrate as shown in FIG. 10*b*. This allows for better control of the fluid, as it is the bottom substrate 16 which controls the fluid via EWOD.

The right hand well in FIG. 6*b* illustrates loading assay fluid that contains surfactant. When the upper seal from the cassette is removed then assay fluid with surfactant might enter the device in the absence of filler fluid, as has been shown in FIG. 6*b*—although whether assay fluid with surfactant will enter in the absence of filler fluid depends on factors such as the surfactant level, the cell gap between the substrates 16,17, and the well design, so assay fluid with surfactant does not necessarily enter the cartridge in the absence of filler fluid. If assay fluid with surfactant does enter the device in the absence of filler fluid the asymmetric leg design will guide the assay fluid into the loading area, as shown in FIG. 6*b*. Filler fluid may then be loaded, and with filler fluid now present the assay fluid can be manipulated using EWOD control onto the main operating area 33 of the device.

If assay fluid with surfactant does not enter the cartridge in the absence of filler fluid, the assay fluid loading process may proceed as described above for the case of assay fluid without surfactant.

FIGS. 5 and 6*a* show an embodiment in which the length $d_2$ of the deeper protrusion 23*b* is equal to the sum of the thickness of the upper substrate 17 and the "cell gap" $C_g$ (the cell gap is the spacing between the upper and lower substrates 16, 17 of the cartridge) so that, when the cassette is placed on the upper substrate, the longer leg 23*b* will make contact with the lower substrate 16 of the cartridge, thereby minimising the risk of deformation or damage to the upper substrate when the cartridge is placed on the device. Preferably the long leg 23*b* is just long enough to touch the bottom substrate when the assay fluid well is positioned (that is, the length $d_2$ of the long leg does not exceed the sum of the thickness of the upper substrate 17 and the cell gap, but the invention is not limited to this. For example, to avoid any risk that the longer leg might damage the lower substrate, one might alternatively design the longer leg 23*b* to be slightly shorter so as to prevent it from making contact with the lower substrate 16. If the longer leg 23*b* is slightly shorter, for example so that there is a gap of around 50 um between the bottom of the longer leg and the upper surface of the bottom substrate 16 the effect of the invention is still achieved—this has been found to create an area where the filler fluid is more likely to make contact with the well, thereby encouraging the filler fluid to pass under the legs of the well.

Providing the shorter leg 23*a* means that there is a clear path for assay fluid to leave the well and enter the operating area 33 of the cartridge. (As noted, the orientation of the assay fluid well in the aperture is important, and the assay fluid well should be oriented such that the loading area 32 is between the operating area 33 and the longer leg 23*b*—or, equivalently, so that the shorter leg of the fluid loader is between the fluid loading area 32 and the operating area 33 of the device.) It has been found that providing this asymmetric arrangement of the two legs provides improved fluid loading performance compared with a design in which the protrusion 23 has a uniform depth that is equal to the separation between the upper and lower substrates of the cartridge.

As shown in FIG. 6*a*, the extent $d_1$ of the shorter leg 23*a* may be made substantially equal to the thickness of the upper substrate 11 so that the end of the shorter leg 23*a* sits approximately flush with the lower surface of the upper substrate when the well is inserted into an aperture in the upper substrate.

In the embodiment of FIGS. 5 and 6*a* the length $d_2$ of the longer protrusion 23*b* is equal to the sum of the thickness of the upper substrate 17 and the "cell gap" $C_g$, or alternatively is very slightly shorter than this so as to prevent the longer protrusion from making contact with the lower substrate 16. The invention is not however limited to this. In practice, the minimum desirable length of the longer protrusion 23*b* is likely to depend on one or more of the filler fluid, the cell gap, and the material used for the assay fluid well. In one example it was found that the length of the longer protrusion 23*b* was preferably equal to or greater than the sum of the thickness of the upper substrate and three quarters of the cell gap between the upper substrate and the lower substrate. In principle, however, there may be cases in which the length of the longer protrusion 23*b* can be even less than this, for example equal to or greater than the sum of the thickness of the upper substrate and half of the cell gap between the upper substrate and the lower substrate.

Figure 7:
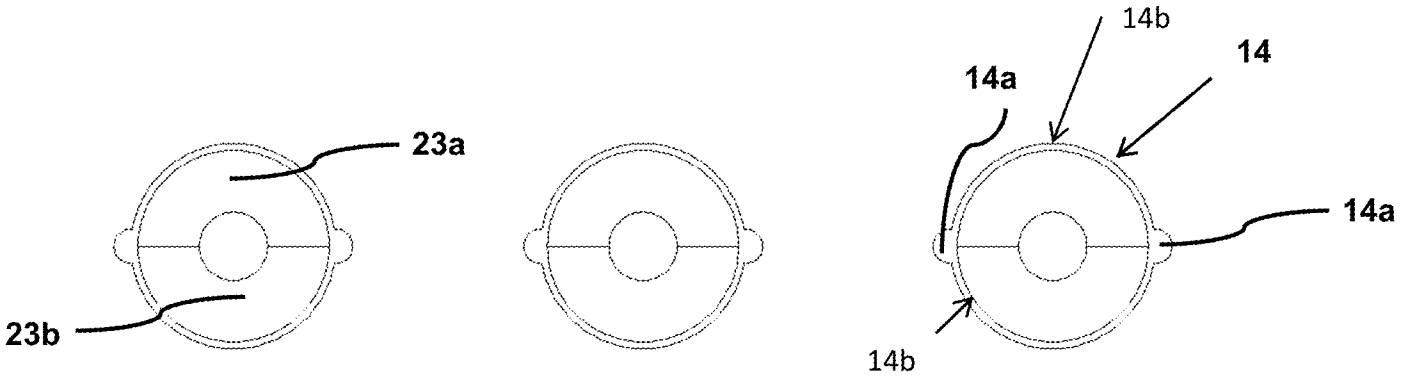
FIG. 7 is a partial plan view of a microfluidic device of the invention.

In a further feature of the invention, the external cross section of the protrusion of 23 on the underside of the well does not exactly conform to the cross-section of the assay fluid filler port 14 so as to provide one or more airgaps between the well and the fluid filler port. For example, an assay fluid filler port 14 may have a generally circular cross-section, but have one or more regions 14*a* of increased diameter as shown in FIG. 7—the portions 14*a* of the aperture have a greater diameter, or greater radius, than the portions 14*b* of the aperture. In this embodiment the protrusion 23 of the well has a circular cross-section so that, when the well is inserted into the assay fluid filler port, the portions 14*a* of greater diameter are not occupied by the protrusion. When fluid enters the fluid chamber, air is then able to vent through the larger diameter portions 14*a* of the port, and this provides a further improvement in fluid loading into the device. (Although a gap is shown in FIG. 7 between a protrusion 23 and the port 14 around the entire circumference of the port, this is for clarity of drawing only. In practice the external diameter of the protrusion 23 would be chosen so that the protrusion was a close fit into the portions 14*b* of aperture 14, so that a significant gap was present only in the regions 14*a* of increased diameter of the protrusion.)

Figure 11:
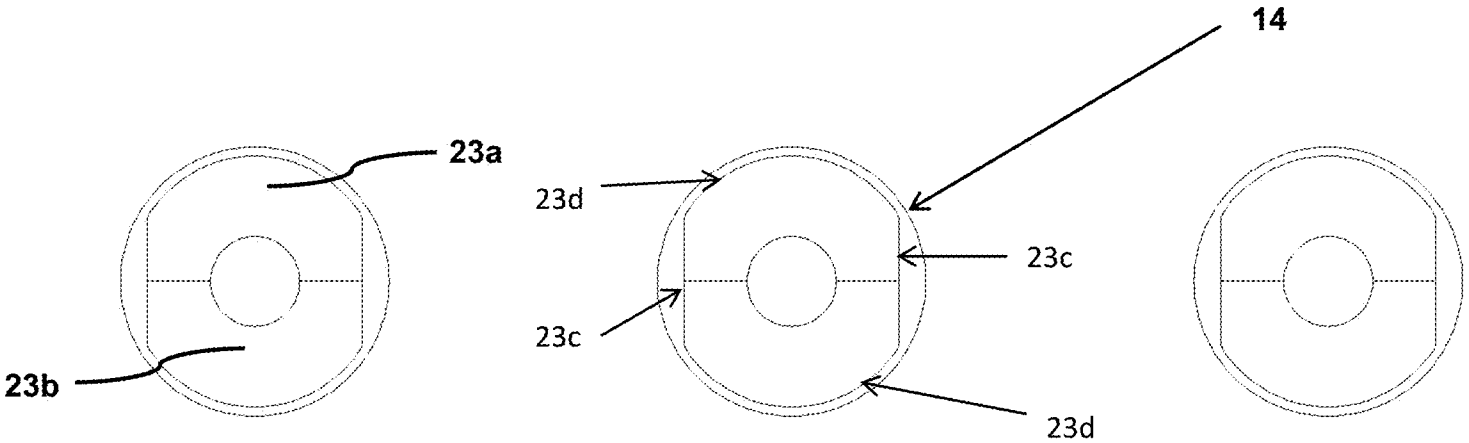
FIG. 11 is a plan view illustrating a further embodiment of the invention.

In an alternative embodiment, the assay fluid loading ports 14 may have a circular cross-section, and the protrusion 23 may have portions 23*c* of reduced diameter, as is shown in FIG. 11. FIG. 11 shows an example which the portions 23*c* have a smaller diameter, or smaller radius, than the portions 23*d*. In this example the portions 23*c* of reduced diameter of the protrusion are flat portions, but the portions of reduced diameter of the protrusion can be obtained in any suitable way. (The gap shown in FIG. 11 between the perimeter of the port and a portion 23*d* of a protrusion having the circular section portion is again for clarity of drawing only.) As described below the cartridge and wells may be formed of moulded plastic, and providing the protrusion 23 with a non-circular cross section may therefore be simpler than providing non-circular fluid loading ports in the upper substrate. In general terms, what is required is that one or more parts of the protrusion 23 of a well have a radius, measured perpendicular to the axis of the well, that is less than the radius of the corresponding part of the port to provide a vent or vents, while one or more other parts of the protrusion 23 have a radius that is equal than the radius of the corresponding part of the port to locate the well correctly in the port.

The precise dimensions of the assay fluid well are chosen to ensure that the well can hold a desired quantity of assay fluid, and to ensure good fluid loading performance. The diameter $D_2$ of the lower aperture of the well will influence the capillary force retaining the assay fluid in the well when the lower seal 22 is removed, as will the internal length of the portion having diameter $D_2$. The angle of slope of the tapered portion of the well will also influence the fluid loading performance. A typical value for $D_2$ is in the range 0.3 mm-3.0 mm and a typical value of $D_1$ is 3 mm to 6 mm. A typical internal slope the tapered portion of the well is between 0° and 80° from the horizontal.

The well may be made of plastics material, for example made from HDPE (high density poly ethylene) or a PC (polycarbonate) material using injection moulding. The choice of the plastics material can affect the properties of the well, as different plastics materials have a different "contact angle" for the fluid. The higher the contact angle of a material the more hydrophobic (water hating) the material is. For example, HDPE has a contact angle of about 96° whereas PC has a contact angle of about 82°. This means that if there are two wells of identical dimensions, one made of HDPE and one made of PC, fluid will enter a device more easily from the HDPE well.

If desired, the internal surface of the well may be coated in order to modify the contact angle. For example, polycarbonate provides a low contact angle, and if the wells are moulded from polycarbonate it may be preferable to coat the internal surfaces of the well, for example using Cytop, to increase the contact angle. Alternatively, it may be desired to lower the contact angle of a well, by coating the internal surfaces of the well with a material having a lower contact angle than the well material.

For the device to work reproducibly it is necessary for the filler fluid to fill the device in a consistent way, with a controlled flow rate. As will be appreciated, filler fluid must pass into the device quite rapidly if it is to overcome the natural boundary that exists between the port in the upper substrate and the protrusion 23 of the well which fits inside the fluid port. Conversely, if the filler fluid fill rate were too high, the fill will become difficult to control and filler fluid might spill over the upper substrate. In addition, if the filler fluid rate were too high, it is possible that the cartridge will quickly fill with filler fluid thereby preventing all of the required assay fluid from entering the fluid chamber of the cartridge.

Figure 8:
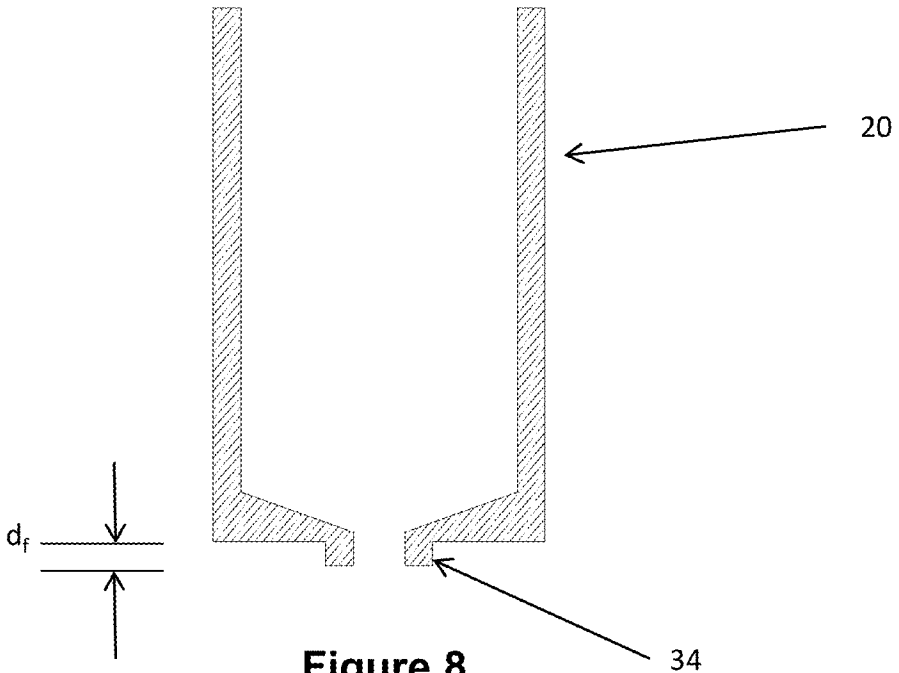
FIG. 8 is a schematic sectional view of a filler fluid well for a microfluidic device of the invention.

FIG. 8 is a cross-section through an example well 20 for filler fluid suitable for use in the invention. The specific dimensions of the well may be chosen so that the well can hold a desired volume of filler fluid. The interior of the well may have a tapered proportion with a slope chosen, to prevent filler fluid from getting caught in corners of the well. As with the assay fluid well, the filler fluid well of FIG. 8 is provided with a protrusion that is shaped and dimensioned so as to be receivable in in the filler fluid port 15 in the upper substrate of the device.

Figure 9:
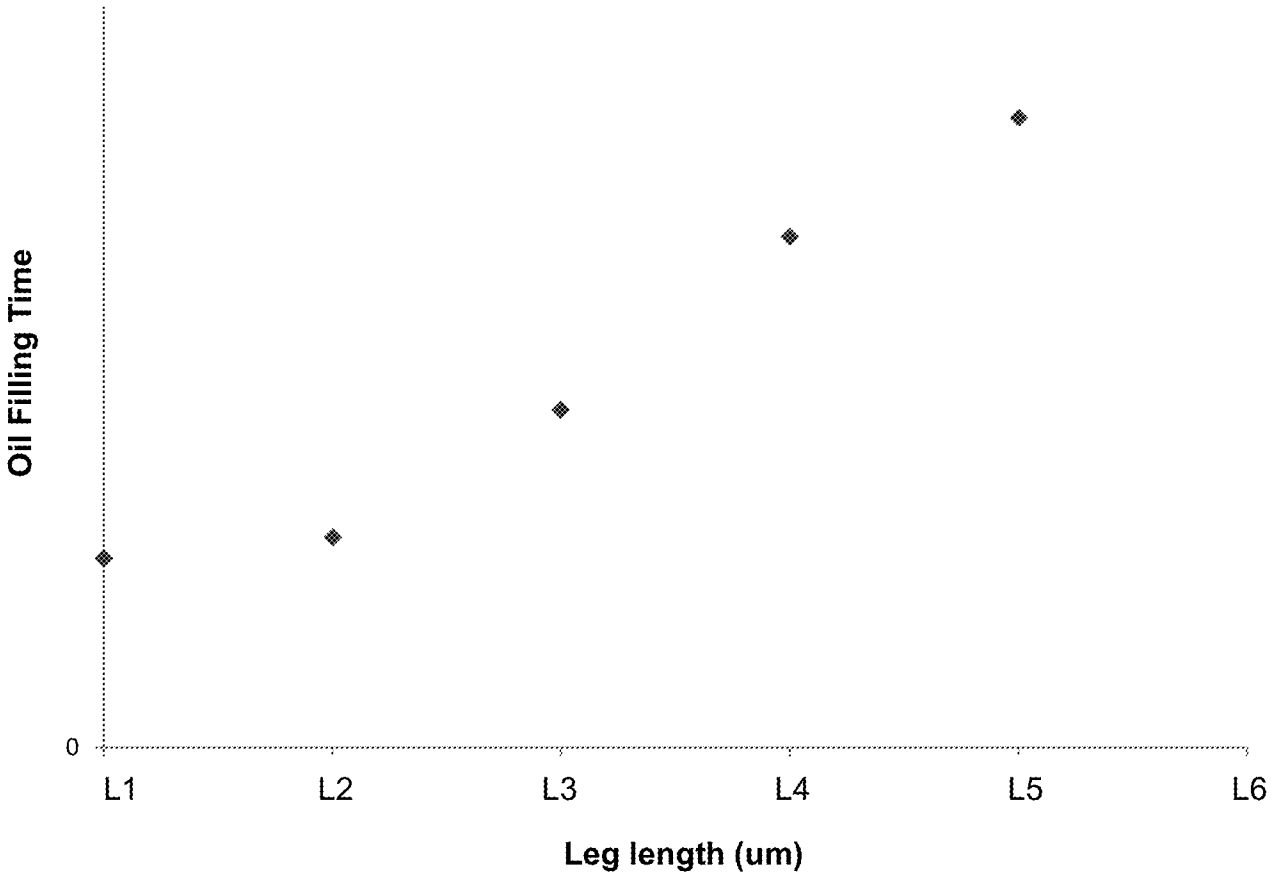
FIG. 9 shows the relationship between the leg length of the filler fluid well of FIG. 5 and the filler fluid filling time.

The time for the filler fluid to fill the fluid chamber of the cartridge can be controlled by adjusting the well design. In particular, the length of the protrusion 34 can provide good control over the rate of filler fluid filling. FIG. 9 illustrates how the time required for filler fluid to fill the fluid chamber of the cartridge varies as a function of the length $d_f$ of the protrusion 34 of the well of FIG. 8. The shortest filler fluid filling time shown in FIG. 9 is obtained with a protrusion length equal to the thickness of the upper substrate (L1 in this example), corresponding to the bottom of the protrusion being flush with the lower surface of the upper substrate. As the protrusion length is increased the filler fluid filling time increases. A protrusion length of L6 (for which no filler fluid filling time is shown in FIG. 9) would correspond to a leg length equal to the thickness of the upper substrate plus the gap between substrates—this corresponds to the bottom of the protrusion touching the upper surface of the lower substrate, which would result in a very long filling time. It is therefore possible to control the filler fluid filling time, by selecting an appropriate protrusion length for the filler fluid well.

Figure 10C:
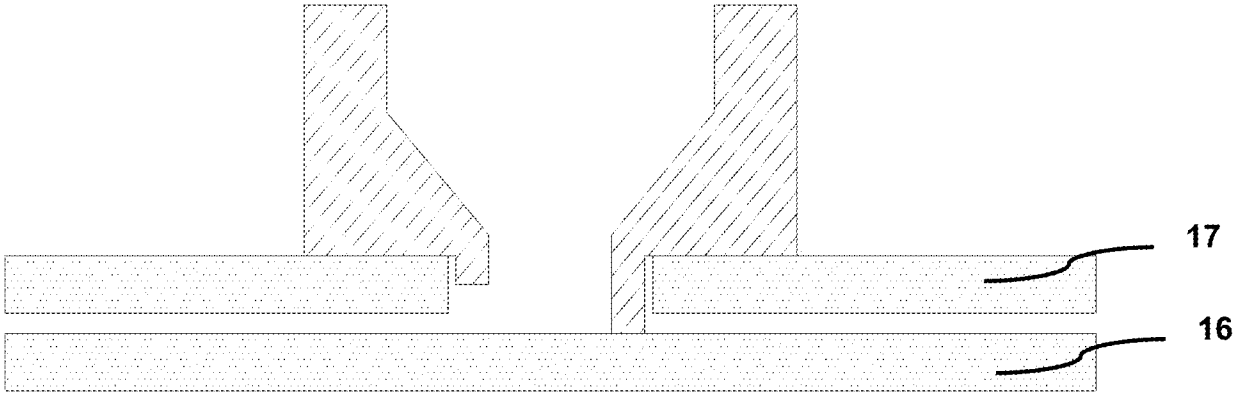
FIGS. 10*c* and 10*d* are part-sectional views illustrating a further advantage of the present invention.
Figure 10D:
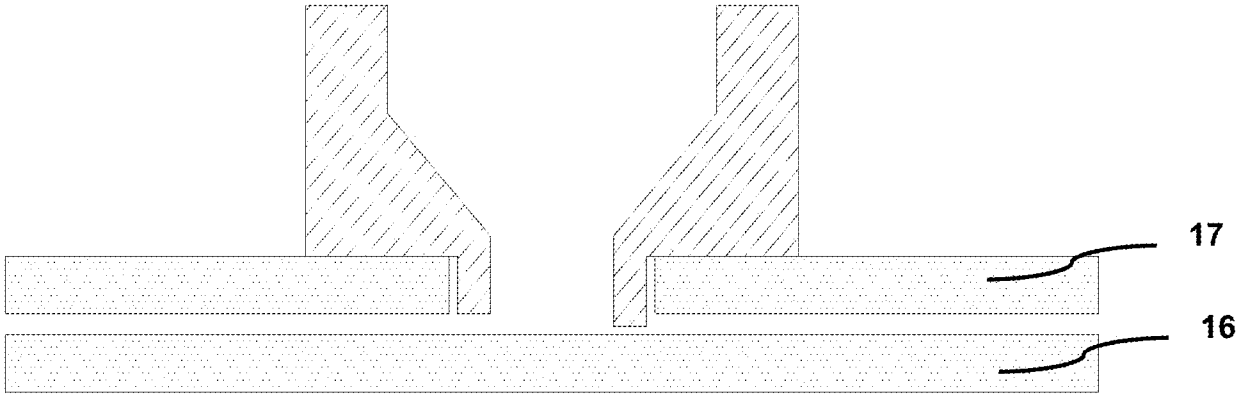
Figure 10E:
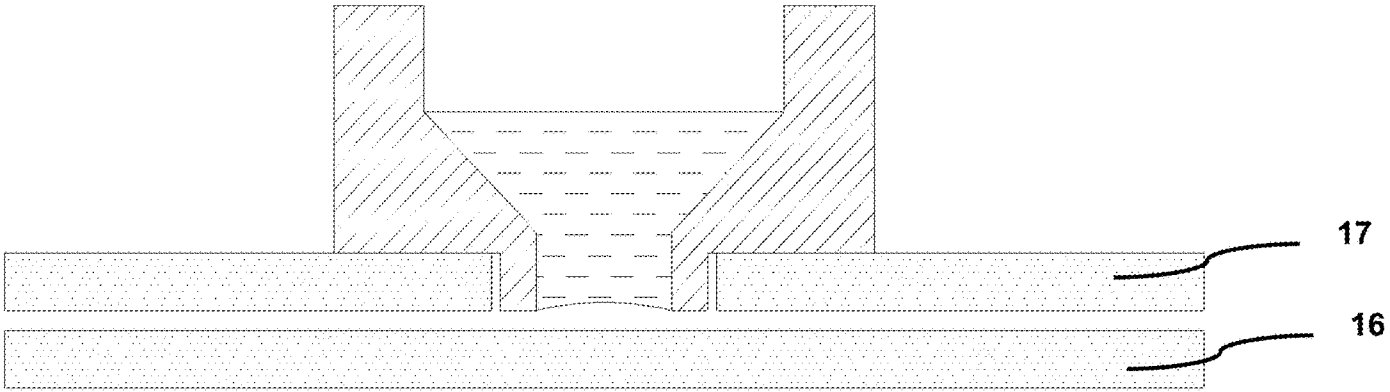
FIG. 10*e* is a part-sectional view of a fluid loader according to a further advantage illustrating the shape of the meniscus provided by fluid in the loader.

As noted, it has been found that provided an assay fluid well with a protrusion that comprises asymmetric legs leads to improved fluid loading into the device. A further advantage of the asymmetric leg arrangement of FIG. 5 is illustrated in FIGS. 10*a* and 10*b*. These are cross-sections through a well inserted into a cartridge, for the case of symmetric legs of length equal to the thickness of the upper substrate (FIG. 10*a*) and for asymmetric legs (FIG. 10*b*). In both figures, the assay fluid in the well does not contain surfactant. In the symmetric case of FIG. 10*a*, the fluid meniscus is parallel to the plane of the substrate—although the meniscus is shown as flat in FIG. 10*a*, in practice the meniscus may "withdraw" due to capillary forces as shown in FIG. 10*e*, and this can cause problems with filler fluid loading into the fluid chambers. In contrast, in FIG. 10*b* the meniscus is at an angle to the plane of the substrates (as mentioned with respect to FIG. 6*b*), and this aids fluid loading into the cartridge. The long leg draws fluid out of the well so that some of the fluid is already contacting (or close to contacting) the lower substrate of the device on which are electrodes for EWOD activation or manipulation or fluid (one or more of the EWOD electrodes provided on the lower substrate may be directly under the aperture).

It should be noted that the invention is not limited to the particular configuration for the protrusion 23 shown in the assay fluid well design of FIG. 5. For example, the shorter leg 23*a* may have an extent that is less than the thickness of the upper substrate, so that the end of the shorter leg 23*a* is recessed compared to the lower face of the upper substrate as shown in FIG. 10*c*. Alternatively, as noted, it is not necessary for the longer leg 23*b* to have an extent equal to the separation between upper and lower substrates, as shown in FIG. 10*d*.

The invention has been described with reference to an individual assay fluid well. In practice, however, it is more likely that the invention would be applied to a cassette that contained multiple assay fluid wells 19 and optionally a well 20 for a filler fluid. The wells of a cassette would be positioned such that, when the cassette is positioned on the cartridge as shown in FIG. 4, the fluid exit of each well would be adjacent a corresponding port 14,15 in the upper substrate of the cartridge—and, in an embodiment in which the base of each well is provided with a protrusion 23, 34, the protrusion of each well would be received in a corresponding port. The wells 19, 20 could be moulded individually, for example by injection moulding, and then mounted into the cassette 18, or the cassette 18 could be moulded in one piece (for example again by injection moulding). In the case of a cassette arranged to extend along all or part of one side of the device, as in FIG. 4, the assay fluid wells would be arranged such that their longer legs 23*b* were all arranged on the same side of the cassette, such that when the cassette was positioned on the cartridge the longer leg of each assay fluid well was placed such that the loading area 32 were between the operating area 33 and the longer leg 23*b*. (In general, a port for filler fluid has a larger diameter than a port for assay fluid, so where a cassette includes a well 20 for filler fluid it is likely that ensuring the well for filler fluid is aligned with the port for filler fluid will ensure that the cassette is correctly oriented on the cartridge such that the loading area 32 is between the operating area 33 and the longer legs 23*b*. If however a cassette could be mounted on the cartridge in more than one orientation, for example if there is no filler fluid well, the cartridge is preferably marked to indicate the correct orientation.) The cassette may take other forms to that shown in FIG. 4—for example a cassette could alternatively be generally "L"-shaped and arranged to extend along two adjacent sides of the device, and in this case the orientation of the assay fluid wells in one leg of the L-shaped cassette would be different to the orientation of the assay fluid wells in the other leg of the L-shaped cassette. This enables every assay fluid well to be arranged such that the loading area was between the longer leg of the well and the operating area of the device, which is a general requirement regardless of the cassette shape or geometry.

If more than one cassette were to be used with a particular cartridge, then any additional cassette wouldn't necessarily need to contain a filler fluid well (the first cassette could, in principle, contain enough filler fluid to fill the device). The filler fluid well will generally have a larger volume than the assay fluid wells, so the cassette height would probably be determined by the filler fluid well height though the filler fluid well could have a much larger diameter than the assay fluid wells to accommodate the large volume. Also, while FIG. 4 shows the cassette as having a uniform height, the cassette height could alternatively be stepped in profile to be greater nearer the filler fluid well and lower near the assay fluid wells.

Figure 12:
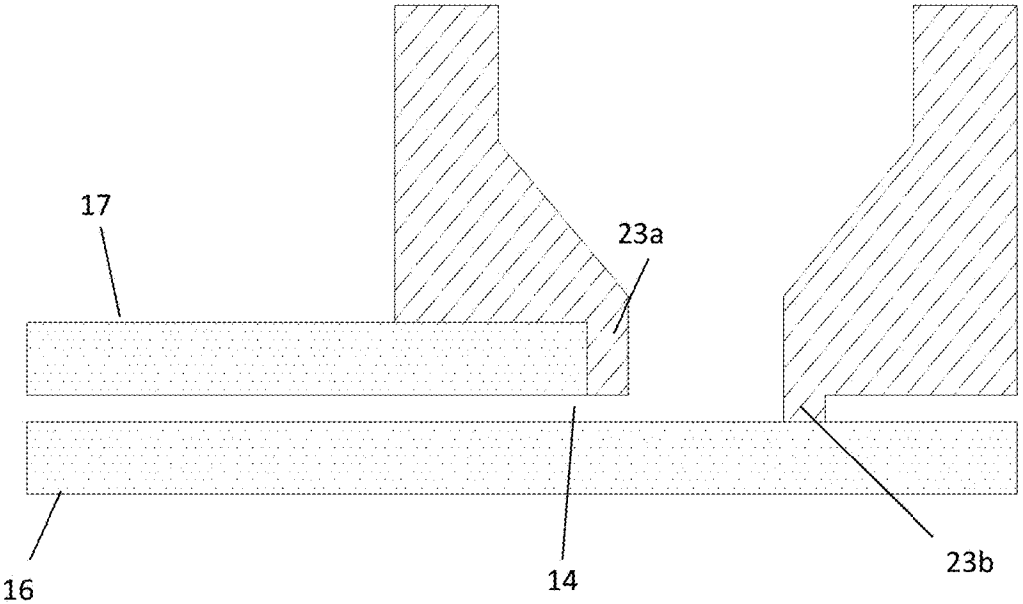
FIG. 12 is a sectional view illustrating a further embodiment of the invention.

In the above embodiment, the assay fluid port and filler fluid port 14, 15 are formed in the upper substrate of the device. However, providing holes in the upper substrate—which is typically made of glass—is difficult, as damage can result when drilling holes in the upper substrate. In a further embodiment of the invention, therefore, fluid is loaded into the fluid chamber from the side, rather than through ports provides in the upper substrate. This is illustrated in FIG. 12. The wells of this embodiment correspond generally to those shown in FIG. 5, except that the short leg 23*a* of the protrusion is configured to allow the well to be abutted against an edge face of the upper substrate (for example if the edge face of the upper substrate is planar the short leg 23*a* of the protrusion may have a flat portion), and the long leg 23*b* is configured to rest on the lower substrate. Thus, as shown in FIG. 12, one or more wells may be placed along the edge face of the upper substrate. It was again found that assay fluid containing no surfactant would sit stably in the assay fluid wells, even with the upper and lower seals removed, without inadvertently entering the device. When filler fluid is introduced into the fluid chamber, by controlling the electrodes appropriately, the assay fluid was drawn onto the active area of the device in a controlled manner.

In the embodiment of FIG. 12 a locator (not shown) may be provided for locating a cassette in its desired position, such that the cassette abuts the side edge face of the upper substrate as shown in FIG. 12. For example a generally "n"-shaped locator similar to the locator 29 of FIG. 3 may be provided on the portion of the lower substrate 16 that extends beyond the upper substrate. Where a device is intended to receive multiple cassettes, one locator may be provided for each cassette.

Figure 13:
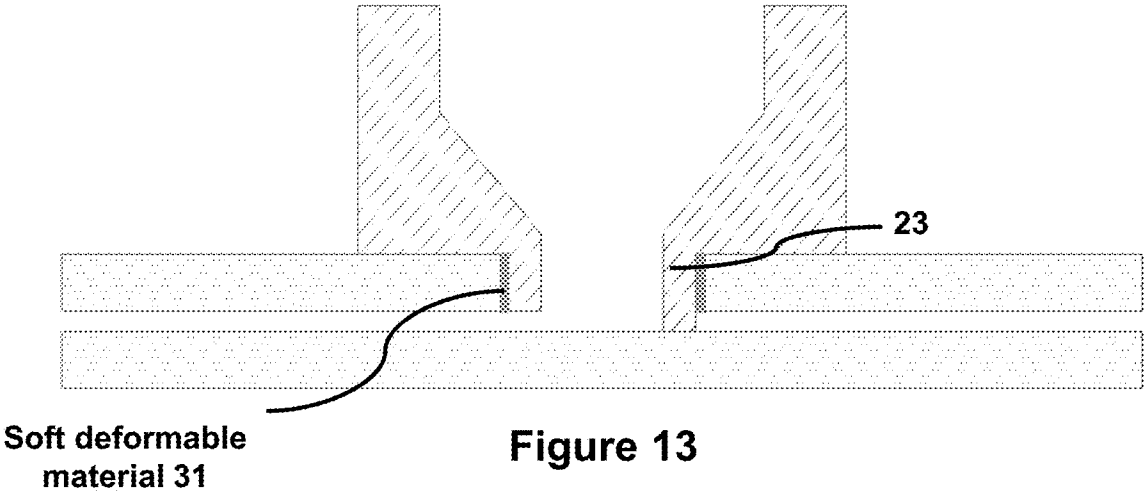
FIG. 13 illustrates a further embodiment of the invention.

In a further embodiment, a two-part moulding technique may be used to provide a well with a hard core (that is, a core that is relatively resistant to deformation), and an external layer of a softer, deformable material around the hard core. This reduces the tolerances required in the manufacturing process, as the softer material can deform to provide a good fit between the protrusion 23 of the well and its respective fluid loading port. At the same time, providing the hard core means that the well is resistant to deformation during handling, unlike the case where the entire well was moulded in a soft material. This is illustrated in FIG. 13, which shows an external layer 31 of a softer, deformable material provided around the protrusion 23 of a well moulded in a harder material. The layer is shown in FIG. 13 as having a depth approximately equal to the thickness of the upper substrate, but this embodiment is not limited to this.

The invention claimed is:

1. A fluid loader for loading fluid into a microfluidic device, the microfluidic device having upper and lower spaced apart substrates defining a fluid chamber therebetween and an aperture connected to the fluid chamber for receiving and directing fluid into the fluid chamber, wherein the fluid loader comprises a fluid well communicating with a fluid exit provided in a base of the fluid loader; and wherein the base of the fluid loader is shaped and configured, in use, to locate the fluid exit of the fluid loader relative to the aperture such that fluid leaving the fluid loader via the fluid exit is first directed into the aperture and then preferentially in a first direction into the fluid chamber of the microfluidic device.

2. A fluid loader as claimed in claim 1, wherein the base comprises a protruding portion so shaped and so dimensioned as to be receivable in the aperture, the protruding portion being shaped to direct fluid leaving the fluid loader preferentially in the first direction.

3. A fluid loader as claimed in claim 2 wherein the protruding portion extends wholly or partially around the fluid exit.

4. A fluid loader as claimed in claim 2, wherein the protruding portion comprises at least first and second legs, the first leg being of different length relative to the second leg.

5. A fluid loader as claimed in claim 4 wherein the length of the first leg is substantially equal to a thickness of the upper substrate.

6. A fluid loader as claimed in claim 4 wherein the length of the second leg is substantially equal to, but is not greater than, a sum of a thickness of the upper substrate and a cell gap that is defined as a space between the upper substrate and the lower substrate.

7. A fluid loader as claimed in claim 2 wherein the protruding portion of the fluid loader and the aperture are so shaped and dimensioned such that, when the protruding portion of the fluid loader is received in the aperture, an airgap exists between the protruding portion of the fluid loader and the aperture.

8. A fluid loader as claimed in claim 7, wherein the aperture defines a first region and a second region, and the first region of the aperture has a greater radius than a radius of the second regions of the aperture.

9. A fluid loader as claimed in claim 7, wherein the protruding portion defines a third region and a fourth region, and the third regions of the protruding portion has a smaller radius than a radius of the fourth region of the protruding portion.

10. A fluid loader as claimed in claim 2 wherein the protruding portion comprises at least one portion made of a material relatively resistant to deformation and at least one portion made of a deformable material.

11. A fluid loader as claimed in claim 1 wherein the base comprises a protruding portion so shaped and so dimensioned as to position the fluid exit adjacent to the aperture, the protruding portion being shaped to direct fluid leaving the fluid loader preferentially in the first direction.

12. A fluid loading cassette comprising two or more fluid loaders for loading a respective assay fluid into a microfluidic device, each fluid loader being a fluid loader as defined in claim 1.

13. A fluid loading cassette as claimed in claim 12 and further comprising a fluid loader for loading filler fluid into the microfluidic device.

14. A fluid loading cassette as claimed in claim 13 wherein a base of the fluid loader for loading filler fluid comprises a protruding portion so shaped and so dimensioned as to be receivable in a corresponding aperture in the microfluidic device and to cause loading of filler fluid into the microfluidic device at a pre-determined rate.

15. A method of loading assay fluid into a microfluidic device, the method comprising:

positioning a fluid loader, the fluid loader comprising a fluid well communicating with a fluid exit provided in a base of the fluid loader, such that the fluid exit is located relative to an aperture in the microfluidic device; and causing assay fluid to pass from the fluid loader into a fluid chamber of the microfluidic device, wherein the aperture is connected to the fluid chamber;

wherein the positioning of the fluid loader comprises locating the fluid exit of the fluid loader relative to the aperture and directing assay fluid leaving the fluid loader via the fluid exit first into the aperture and then preferentially in a first direction into the fluid chamber of the microfluidic device.

16. The method as claimed in claim 15, wherein the base of the fluid loader comprises a protruding portion having at least first and second legs, the first leg being shorter than the second leg, and the method comprises positioning the fluid loader such that the first leg of the fluid loader is located between a fluid loading area associated with the aperture and an operating area of the microfluidic device, wherein the operating area comprises the fluid chamber.

17. The method as claimed in claim 15, wherein the microfluidic device includes an upper substrate and a lower substrate spaced apart by a spacer to define the fluid chamber, and the fluid loader is positioned such that the fluid exit is located in an aperture in the upper substrate of the microfluidic device.

18. The method as claimed in claim 15, wherein the microfluidic device includes an upper substrate and a lower substrate spaced apart by a spacer to define the fluid chamber, and the fluid loader is positioned such that the fluid exit is adjacent an aperture defined at a side of the microfluidic device and between the upper substrate of the microfluidic device and the lower substrate of the microfluidic device.

19. The method as claimed in claim 15, wherein causing assay fluid to pass from the fluid loader into the fluid chamber of the microfluidic device comprises venting the fluid loader at a point above an upper surface of assay fluid contained in the fluid loader, and introducing a filler fluid into the fluid chamber of the microfluidic device.

20. The method as claimed in claim 15, further comprising introducing a filler fluid into the fluid chamber of the microfluidic device before the assay fluid is passed from the fluid loader into the fluid chamber.

21. The method as claimed in claim 15, further comprising:

providing a fluid loading cassette including two or more of the fluid loaders for loading a respective assay fluid into the microfluidic device, with each fluid loader comprising a respective fluid well communicating with a fluid exit provided in a base of the respective fluid loader;

positioning the fluid loading cassette such that the respective fluid exits of the fluid loaders are located in respective apertures in the microfluidic device; and causing assay fluid to pass from at least one fluid loader of the fluid loading cassette into the fluid chamber of the microfluidic device.

22. The method as claimed in claim 21, wherein one of the fluid loaders is a fluid loader for loading filler fluid into the microfluidic device, and the method comprises venting at least one assay fluid-containing fluid loader of the cassette, and subsequently venting the filler fluid-containing fluid loader of the cassette.

* * * * *